US011832671B1

(12) United States Patent
Cardenas, III

(10) Patent No.: US 11,832,671 B1
(45) Date of Patent: Dec. 5, 2023

(54) CAP PROTECTOR

(71) Applicant: Manuel Christian Cardenas, III, Dallas, TX (US)

(72) Inventor: Manuel Christian Cardenas, III, Dallas, TX (US)

( * ) Notice: Subject to any disclaimer, the term of this patent is extended or adjusted under 35 U.S.C. 154(b) by 144 days.

(21) Appl. No.: 17/481,116

(22) Filed: Sep. 21, 2021

Related U.S. Application Data

(60) Provisional application No. 63/054,350, filed on Jul. 21, 2020.

(51) Int. Cl.
*A42B 1/002* (2021.01)
*B65D 85/18* (2006.01)

(52) U.S. Cl.
CPC ..... *A42B 1/002* (2013.01); *B65D 85/18* (2013.01)

(58) Field of Classification Search
CPC .. A42B 1/002; A42B 1/18; A42C 3/02; A47G 25/10; B65D 85/18
USPC ..... 2/175.4; D3/269
See application file for complete search history.

(56) References Cited

U.S. PATENT DOCUMENTS 1,787,727 A * 1/1931 Hildreth ..... A42B 1/002 206/9
1,954,565 A * 4/1934 Ford ..... A42B 1/002 2/195.6
4,673,153 A * 6/1987 Hilty ..... A47F 7/06 D6/326
5,012,531 A * 5/1991 Schoonover ..... A42B 1/002 223/66
5,074,410 A * 12/1991 Fries ..... B65D 85/18 190/117
5,172,837 A * 12/1992 Finney, Jr. ..... A42B 1/002 223/66
5,188,325 A * 2/1993 Hilty ..... A47F 7/06 211/32
5,240,123 A * 8/1993 Hawk ..... A47F 7/06 211/32
D355,600 S * 2/1995 Ford ..... D9/415
D361,197 S * 8/1995 Wilson ..... D2/892
5,480,023 A * 1/1996 Puller ..... A45C 7/0063 206/8
5,647,064 A * 7/1997 Whittaker ..... A42B 1/002 2/181.2
5,813,546 A * 9/1998 Wilson ..... A47F 7/06 D9/632
D402,808 S * 12/1998 Deloach ..... D3/269
5,865,333 A * 2/1999 Wolfe ..... A45C 11/02 206/8
6,125,997 A * 10/2000 Campbell ..... A45C 11/02 206/8

(Continued)

FOREIGN PATENT DOCUMENTS

WO WO-2017106927 A1 * 6/2017

*Primary Examiner* — Heather Mangine
(74) *Attorney, Agent, or Firm* — Kenneth L. Tolar

(57) ABSTRACT

A cap protector includes a unitary rigid shell having an open rear in communication with an interior chamber that is dimensioned and configured to receive the crown portion of a cap. Integrally extending from the lower, front portion of the shell is a substantially planar panel configured to resemble the cap's bill. The panel includes a slot in communication with an interior cavity that is dimensioned to firmly receive the cap bill. On the upper surface of the shell is a grommet with a locking mechanism that grips the cap's crown button.

6 Claims, 5 Drawing Sheets

(56) References Cited

U.S. PATENT DOCUMENTS 6,223,910 B1 * 5/2001 Levin ..... A47F 7/06 211/113
6,510,972 B1 * 1/2003 Briskey ..... A47G 25/10 223/24
8,191,742 B1 * 6/2012 Brewer ..... A42B 1/002 223/12
8,220,673 B1 * 7/2012 Levin ..... A42B 1/002 223/66
8,857,676 B1 * 10/2014 Navarro ..... A42B 1/002 2/175.4
9,993,042 B1 * 6/2018 Miller ..... A42B 1/048
10,433,625 B1 * 10/2019 Belizaire ..... A45C 11/02
D919,967 S * 5/2021 Hamilton ..... D9/415
D965,243 S * 9/2022 Wang ..... D32/59
2004/0231031 A1 * 11/2004 Cho ..... A42B 1/0181 2/175.4
2005/0211574 A1 * 9/2005 Reeve ..... A45C 11/02 206/8
2006/0124563 A1 * 6/2006 Penson ..... A47G 25/10 211/113
2007/0033705 A1 * 2/2007 Dickson ..... A42B 1/02 2/175.6
2007/0199833 A1 * 8/2007 Hunt, Sr. ..... A45C 11/02 206/8
2014/0001323 A1 * 1/2014 Vargas Duenas ..... A47G 25/10 248/206.5
2016/0100645 A1 * 4/2016 Mondrella ..... A47G 25/10 223/84
2019/0315282 A1 * 10/2019 Murray ..... B60R 7/10
2019/0390397 A1 * 12/2019 Wynn ..... A42B 1/002
2020/0146470 A1 * 5/2020 Quezada ..... A47F 7/06
2020/0359726 A1 * 11/2020 Hamilton ..... A45C 11/02

* cited by examiner

CAP PROTECTOR

CROSS REFERENCE TO RELATED APPLICATIONS

This application claims priority of provisional application No. 63/054,350 filed on Jul. 21, 2020, the specification of which is incorporated herein by reference.

BACKGROUND OF THE INVENTION

The present invention relates to a unitary shell for protecting a ball cap during transport or storage.

DESCRIPTION OF THE PRIOR ART

Storing or transporting a ball cap has always been challenging and problematic. If placed on a shelf, the cap collects mold and dust. If the shelf is exposed to sunlight, the cap's fabric or logo can fade significantly and diminish the cap's value, particularly if it is a collector's item. If multiple caps are stacked, the lowermost caps get crushed and deformed. Suspending the cap by the rear adjustment strap causes the cap to elongate and fit poorly when ready to wear.

Transporting a cap within a suitcase or other luggage item is particularly challenging. The crown is often compressed by clothing, causing the fabric and logo to wrinkle and the bill to bend. If the bill is bent to a certain angle, the cap may be ruined. Cap wearers who are fastidious about cap appearance are severely annoyed if forced to wear a deformed cap.

Accordingly, there is currently a need for a device that protects a cap from debris, sunlight and deformation while being stored. The present invention satisfies this need by providing a unitary, rigid shell having a pair of cavities for receiving the bill and crown of a cap to prevent deformation.

SUMMARY OF THE INVENTION

The present invention relates to a cap protector comprising a unitary rigid shell having an open rear in communication with an interior chamber that is dimensioned and configured to receive the crown portion of a particular cap. Integrally extending from the lower, front portion of the shell is a substantially planar panel configured to resemble the cap's bill. The panel includes a slot in communication with an interior cavity that is dimensioned to firmly receive the cap bill. On the upper surface of the shell is a grommet with a locking mechanism that grips the cap's crown button.

It is therefore an object of the present invention to provide a device that protects the structural integrity of a cap during transport and storage.

It is therefore another object of the present invention to provide a cap protector constructed with a lightweight, rigid material that prevents a cap bill from bending or the crown from collapsing.

It is yet another object of the present invention to provide a cap protector having a unique locking system for gripping a cap's crown button.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
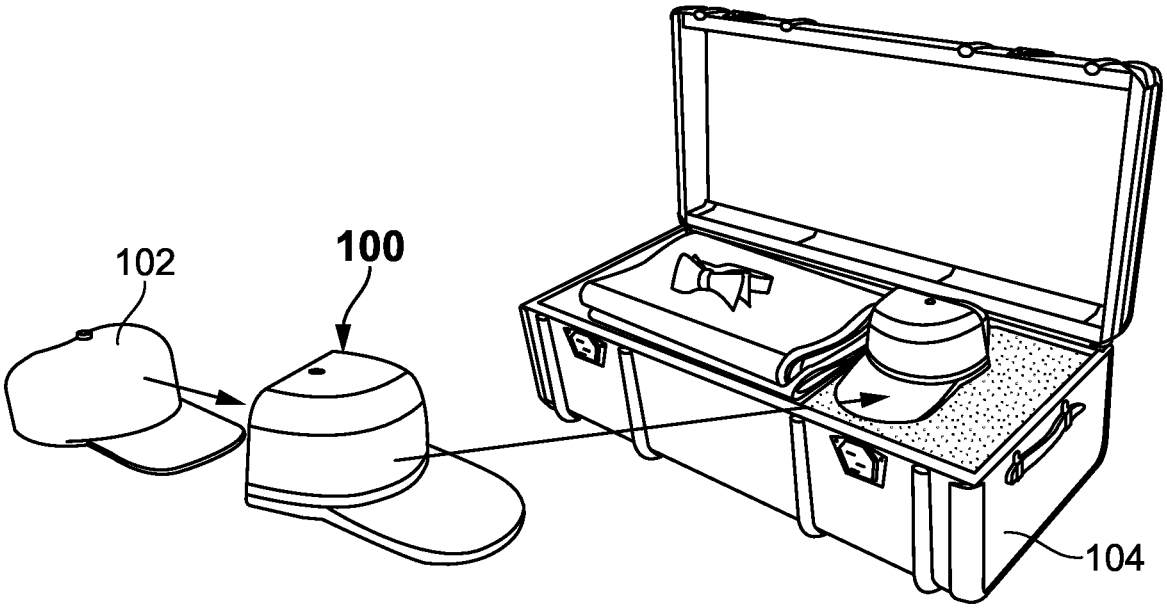
FIG. 1 depicts the protector according to the present invention being used to store a cap in a luggage item.
Figure 2:
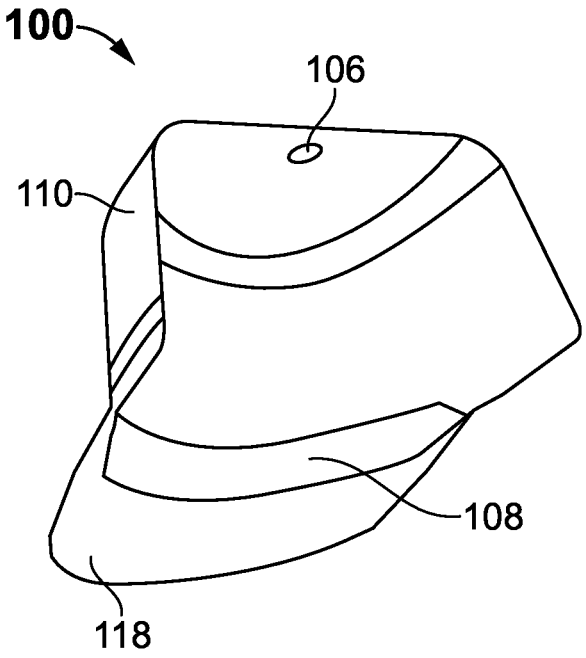
FIG. 2 is an isolated, rear perspective view of the cap protector.
Figure 3:
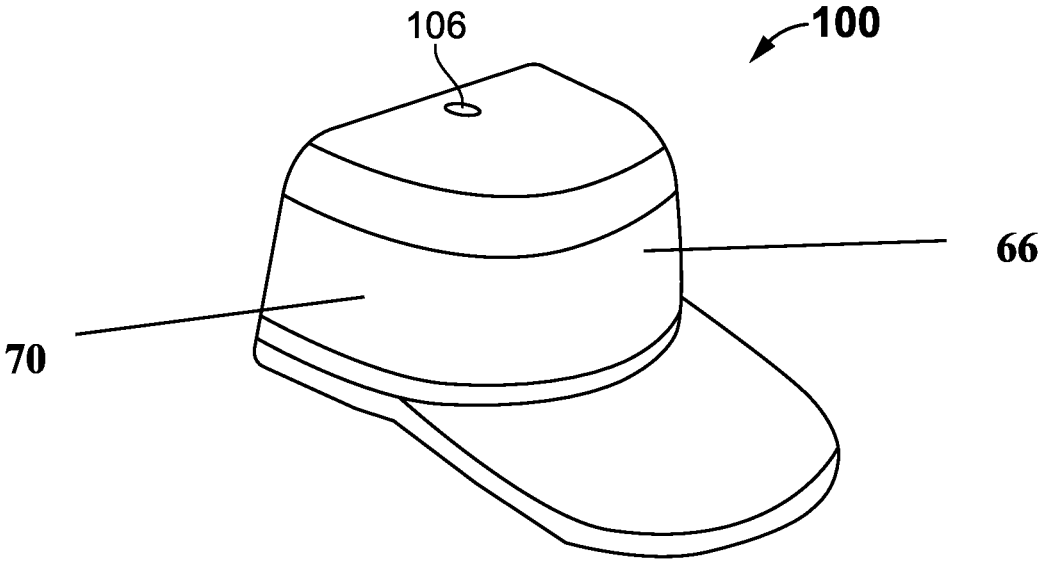
FIG. 3 is an isolated, front perspective view of the cap protector.
Figure 4:
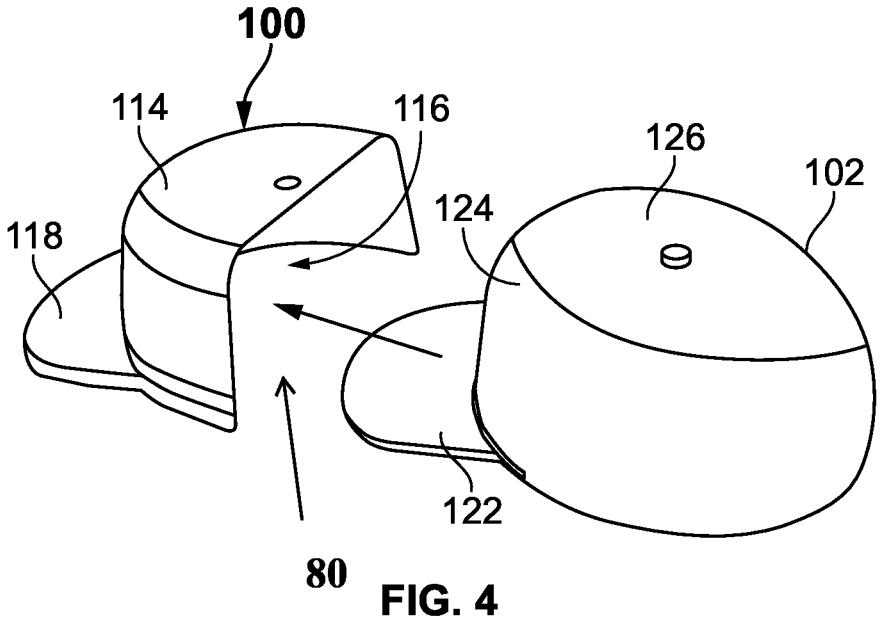
FIG. 4 depicts a cap being inserted into the cap protector.
Figure 5:
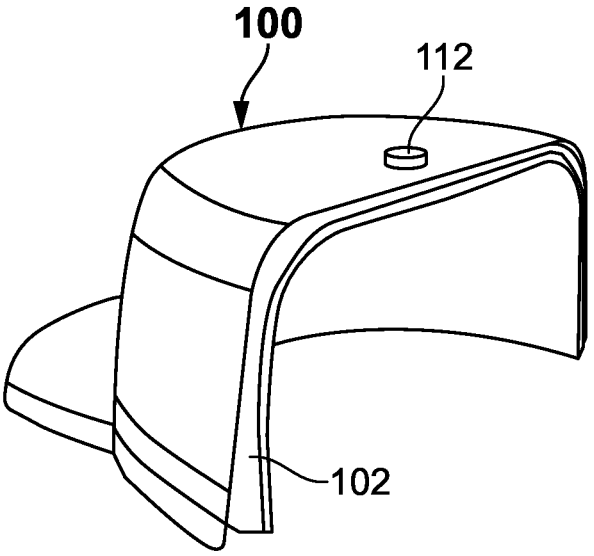
FIG. 5 depicts a cap being stored within the cap protector.
Figure 6:
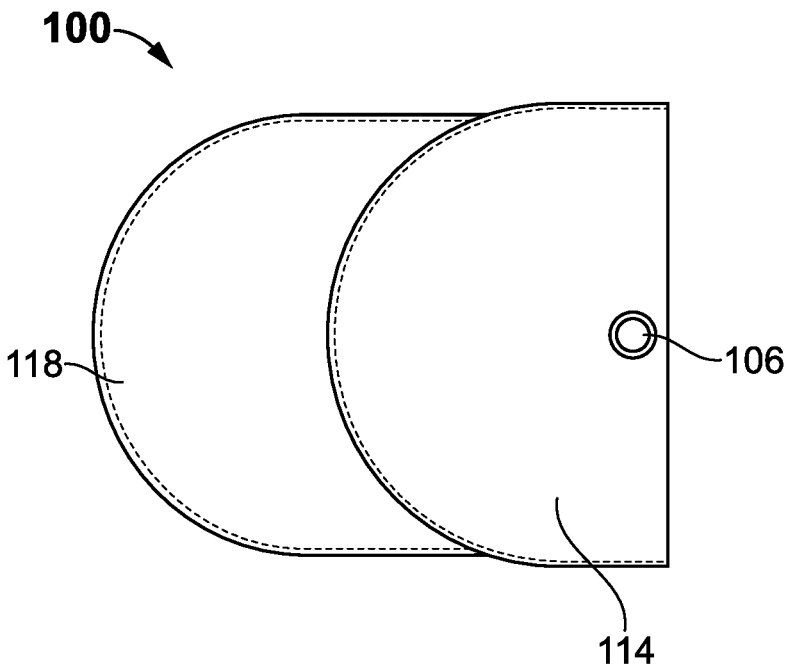
FIG. 6 is a top view of the cap protector.
Figure 7:
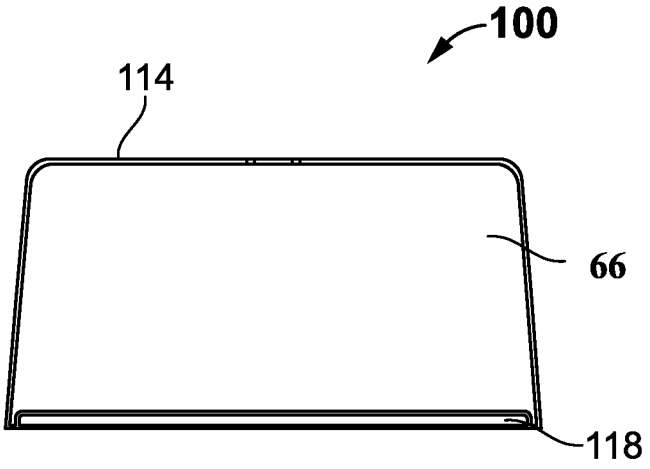
FIG. 7 is a front view of the cap protector.
Figure 8:
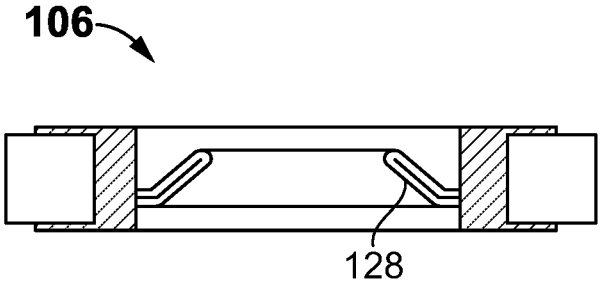
FIG. 8 is a sectional view of the button retainer.

The present invention relates to a protector 100 for protecting the structural integrity of a given cap 102 when packed within a luggage item 104 or placed within another storage location. The cap 102 includes a bill 122, a crown 126, and peripheral portion 124 that are easily crushed or deformed when stored. The protector 100 according to the present invention comprises a unitary, rigid shell 110 having an upper surface 114, a front surface 66, a lower edge, an outer wall 70, and an open rear 80 in communication with an interior chamber 116 that is dimensioned and configured to receive the crown portion 126 of a particular cap, i.e., a baseball style cap. The front surface may include a logo, artwork, design elements or similar ornamentation. The shell 110 is preferably constructed with polypropylene plastic or a similar lightweight, rigid material that prevents an enclosed cap from being crushed when stored. Integrally extending from the lower edge of the front surface is a substantially planar panel 118 configured to resemble the bill of the cap. The panel 118 includes a slot in communication with an interior cavity 108 that is dimensioned to firmly receive the cap bill 122.

On the upper surface of the interior crown chamber 116 is a grommet 106 that is dimensioned to receive the cap's button 112. Within the grommet 106 is a button retainer including a pair of resilient, biased fingers 128 that separate slightly when subjected to force but return to an original position when released to firmly grip the lower surface of the button 112. The button includes a tactile membrane that emits a clicking noise to alert a user that the button has been fully inserted.

As readily apparent from the detailed description, the present invention provides an easy and convenient means of storing and protecting a cap to prevent crushing, distorting, or bending. To store a cap, a user inserts the cap bill into the protector cavity 108, folds the rear section of cap crown 126 against the front portion of the crown 126 and the interior surface of the cap's front surface 66. The button 112 is then pushed into the button retainer until the user hears a click, which indicates that the crown button is locked within the grommet.

The above-described device is not limited to the exact details of construction and enumeration of parts provided herein. Furthermore, the size, shape and materials of construction of the various components can be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A cap protector comprising:

a shell having an upper surface, a front surface and an open rear in communication with an interior chamber, said interior chamber dimensioned and configured to receive a crown portion of a cap;

a panel extending from the front surface of said shell, said panel having a slot in communication with an interior cavity that is dimensioned to receive a bill of the cap;

a grommet on the upper surface of said shell, said grommet dimensioned to receive a crown button on said cap.

2. The cap protector according to claim 1 wherein said shell is constructed with a rigid material that prevents the cap enclosed within the cap protector from being crushed when stored.

3. The cap protector according to claim 1 further comprising a button retainer within said grommet, said button retainer including a pair of resilient, biased fingers that separate when subjected to force but return to an original position when released to firmly grip a lower surface of the crown button.

4. A combination of a cap protector and a cap, the cap comprising a bill, a crown, a peripheral portion and a button on said crown; the cap protector comprising a shell having an upper surface, a front surface and an open rear in communication with an interior chamber, said interior chamber receiving said crown; and a panel extending from the front surface of said shell, said panel having a slot in communication with an interior cavity, said bill received within said cavity, and a grommet on the upper surface of said shell, said button received within said grommet.

5. The combination according to claim 4 wherein said shell is constructed with a rigid material that prevents the crown and said bill from bending or contorting.

6. The combination according to claim 4 further comprising a button retainer within said grommet, said button retainer including a pair of resilient, biased fingers that separate when subjected to force but return to an original position when released to firmly grip a lower surface of said button.

* * * * *